US012187525B2

(12) United States Patent
Kittle

(10) Patent No.: US 12,187,525 B2
(45) Date of Patent: Jan. 7, 2025

(54) SOFT AND FLEXIBLE PORTABLE COOLER

(71) Applicant: FOAM LLC, Charlotte, NC (US)

(72) Inventor: David Ryan Kittle, Charlotte, NC (US)

(73) Assignee: FOAM LLC, Charlotte, NC (US)

( * ) Notice: Subject to any disclaimer, the term of this patent is extended or adjusted under 35 U.S.C. 154(b) by 106 days.

(21) Appl. No.: 18/150,005

(22) Filed: Jan. 4, 2023

(65) Prior Publication Data

US 2024/0076115 A1 Mar. 7, 2024

Related U.S. Application Data

(63) Continuation-in-part of application No. 29/866,596, filed on Sep. 20, 2022.

(60) Provisional application No. 63/374,537, filed on Sep. 3, 2022.

(51) Int. Cl.
*B65D 81/38* (2006.01)
*B65D 25/28* (2006.01)

(52) U.S. Cl.
CPC ..... *B65D 81/389* (2013.01); *B65D 25/2873* (2013.01)

(58) Field of Classification Search
CPC ..... B65D 81/389; B65D 25/2873; B65D 81/3816; B65D 2585/6812; B65D 5/0281; B65D 5/566; B65D 5/58; B65D 7/22; B65D 9/02; B65D 9/04; B65D 9/26
See application file for complete search history.

(56) References Cited

U.S. PATENT DOCUMENTS

| | | | | |
|---|---|---|---|---|
| 3,225,983 | A | 12/1965 | Majka | |
| 4,537,313 | A | 8/1985 | Workman | |
| 5,095,718 | A | 3/1992 | Ormond et al. | |
| 5,169,164 | A * | 12/1992 | Bradford | B62B 5/0083 280/47.131 |
| 5,689,970 | A | 11/1997 | Chopas | |
| 5,918,478 | A | 7/1999 | Bostic et al. | |
| 6,884,450 | B2 | 4/2005 | Wu et al. | |
| 6,983,946 | B2 * | 1/2006 | Sullivan | B65D 25/2841 220/4.27 |
| 7,757,878 | B2 * | 7/2010 | Mogil | B65D 81/3858 220/592.2 |
| 8,181,811 | B1 * | 5/2012 | Blake | A45B 23/00 248/156 |
| 8,973,772 | B2 | 3/2015 | G De Quevedo-Dominguez | |
| 9,623,890 | B1 * | 4/2017 | Horowitz | B62B 3/007 |
| 2004/0262319 | A1 * | 12/2004 | Fisher | F25D 3/08 220/528 |

(Continued)

*Primary Examiner* — Kareen K Thomas
(74) *Attorney, Agent, or Firm* — The Van Winkle Law Firm; William G. Heedy

(57) ABSTRACT

A container (100), such as a cooler, has a center section (108), a bottom section, and a cover or lid. The center section has a plurality of outer walls (202) and a plurality of partial columns (210). Each outer wall has an inner surface (206), an outer surface (202), a top surface, a thickness, and a plane (204, 208) defined by the outer surface. Each partial column has an inner surface (214), an outer surface (212), a top surface (218), and a thickness, and defines a corner angle (216), such as approximately 90 degrees. The partial columns alternate with the outer walls, and the outer surface of a partial column extends beyond the plane of an adjacent outer wall. The center section and the bottom section are a unitary structure formed of a flexible insulating material, such as an EVA foam.

20 Claims, 8 Drawing Sheets

(56) References Cited

U.S. PATENT DOCUMENTS

| | | | | |
|---|---|---|---|---|
| 2006/0091139 | A1 | 5/2006 | Grogan et al. | |
| 2007/0012695 | A1 | 1/2007 | Yang | |
| 2009/0139248 | A1* | 6/2009 | Crumlin | A45F 3/10 220/592.27 |
| 2009/0261111 | A1* | 10/2009 | Hsu | B65D 81/3818 220/666 |
| 2010/0005827 | A1* | 1/2010 | Winkler | F25D 3/08 62/457.2 |
| 2011/0148265 | A1* | 6/2011 | Wood | F25D 21/04 220/378 |
| 2012/0273505 | A1* | 11/2012 | Bose | A45C 13/02 220/592.16 |
| 2018/0066882 | A1* | 3/2018 | Grepper | B01F 33/501 |
| 2018/0186547 | A1* | 7/2018 | Morine | A47G 23/02 |
| 2018/0186550 | A1* | 7/2018 | Morine | B65D 43/16 |
| 2018/0215508 | A1* | 8/2018 | Yockey | B65D 81/3816 |
| 2018/0266747 | A1* | 9/2018 | Grepper | A45C 11/20 |
| 2019/0234671 | A1* | 8/2019 | Stanford | B65D 81/3811 |

* cited by examiner

SOFT AND FLEXIBLE PORTABLE COOLER

CROSS REFERENCE TO RELATED APPLICATIONS

The present application claims the priority of U.S. Provisional Patent Application Ser. No. 63/374,537 filed Sep. 3, 2022, entitled "SOFT AND FLEXIBLE NON-FABRIC, NON-ELECTRIC PORTABLE COOLER", and U.S. Design application Ser. No. 29/866,596, filed Sep. 20, 2022, entitled "FOAM COOLER", both of which are incorporated herein in their entirety.

SUMMARY

A container, such as a cooler, has a center section and a bottom section. The center section has a plurality of outer walls and a plurality of partial columns. Each outer wall has an inner surface, an outer surface, a top surface, a thickness, and a plane defined by the outer surface. Each partial column has an inner surface, an outer surface, a top surface, a thickness, and defines a corner angle. The partial columns alternate with the outer walls, the outer surface of a partial column extends beyond the plane of an adjacent outer wall of the plurality of outer walls. The center section and the bottom section are a unitary structure formed of a flexible insulating material.

DETAILED DESCRIPTION

Most conventional coolers use an insulating foam which is then encased in plastic because most foams are not durable, can be easily damaged, and/or soak up water. For example, cheap Styrofoam coolers do not have a protective shell and, because they can be easily damaged, are often discarded after only a few uses. Hard-sided coolers, however, use foam between inner and outer walls, and this necessitates the use of different types of materials. For example, a hard-sided cooler will have a plastic interior, extruded polystyrene (Styrofoam) as an insulator around the plastic interior, and then a plastic or metal exterior, which plastic may be different than that used for the interior. Some expensive coolers use a rotomolded plastic interior, polyurethane foam insulation and a rotomolded plastic exterior. A soft-sided cooler may use fabric exterior and interior skins, with polyethylene (PE) foam inside to provide structure and insulation. These conventional designs therefore have several undesirable characteristics, some of which are mentioned above, and others of which are mentioned below.

Figure 1:
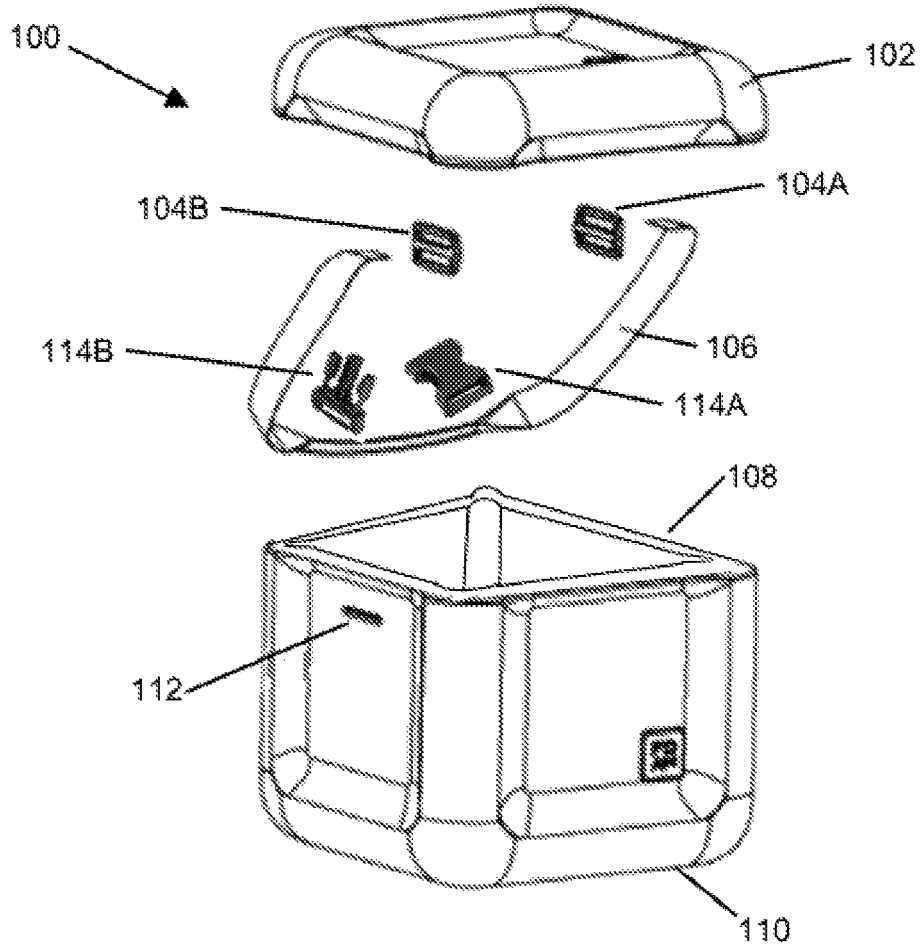
FIG. 1 is an exploded view illustration of an embodiment of a cooler.

A flexible and soft, non-fabric, insulated container, also commonly referred to as an ice chest or a cooler, is disclosed. For convenience of discussion, the term "cooler" is used herein. FIG. 1 is an exploded view illustration of an embodiment of a cooler 100, showing a cover or lid 102, a center or body section 108, and a bottom section 110. In an embodiment, the center section 108 and the bottom section 110 are unitary, that is, a single molded piece.

Also shown are an optional handle or strap 106, buckles 104A, 104B, releasable buckle 114A, 114B, and one slot 112 of two optional slots into which the optional handle 106 and buckles 104 are inserted. The handle or strap 106 may be used to carry the cooler 100. Also, the releasable buckle 114A, 114B may be closed to conveniently secure the cover 102 to the body section 108.

Figure 2:
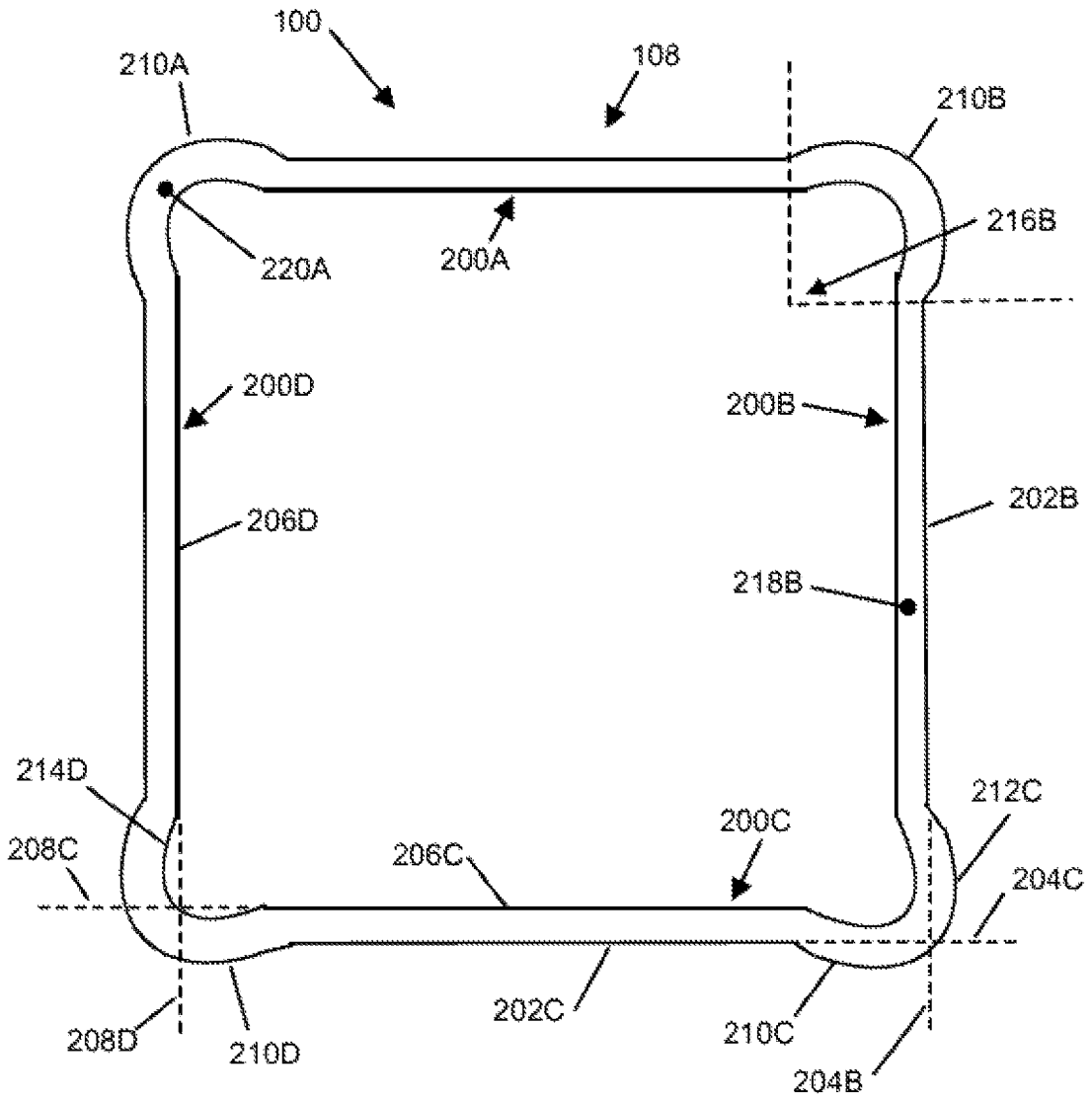
FIG. 2 is a top view illustration of the center section of the cooler.

FIG. 2 is a top view illustration of the center section 108 of the cooler 100 showing a plurality of walls 200A-200D, and a plurality of partial columns 210A-210D, the walls 200 alternating with the partial columns 210. The outer surface 202 of a wall 200 defines a plane 204. For example, the outer surface 202B of wall 200B defines a plane 204B, the outer surface 202C of wall 200C defines another plane 204C, and so on. The outer surface 212 of a partial column 210 extends beyond the planes 204 of its associated walls 200. For example, the outer surface 212C of partial column 210C extends beyond planes 204B and 204C of associated walls 200B and 200C.

In an embodiment, a wall 200, such as wall 200B, has a top surface 218, such as top surface 218B, and a partial column 210, such as partial column 210A, has a top surface 220, such as top surface 220A.

In an embodiment, a partial column 210, such as partial column 210B, defines a corner angle 216, such as corner angle 216B, of approximately 90 degrees.

For clarity and convenience of illustration, not all planes or surfaces are shown or numbered.

The inner surface 206 of a wall 200 also defines a plane 208. For example, the inner surface 206D of wall 200D defines a plane 208D, the inner surface 206C of wall 200C defines another plane 208C, and so on. The inner surface 214 of a partial column 210 preferably extends beyond the planes 208 of its associated walls 200. For example, the inner surface 214D of partial column 210D preferably extends beyond planes 208C and 208D of associated walls 200C and 200D. Again, for clarity and convenience of illustration, not all planes or surfaces are shown or numbered.

This embodiment is advantageous in that it can be manufactured from a single material that has insulation capabilities, which is discussed further below. Other advantages of this embodiment are: it weighs less than many conventional coolers, only one-sixth the weight of some coolers, so it is convenient to use and ship; it is easier, and less expensive, to manufacture than, for example, hard-sided coolers; it is easier to recycle as, except for the strap and buckles, it is made from a single material so disassembly and/or sorting are quickly and easily accomplished; and it is easier to clean, for example, it is "dishwasher safe."

The cooler 100 has an indented paneling look due to the alternating partial columns 210 and walls 200.

Figure 3:
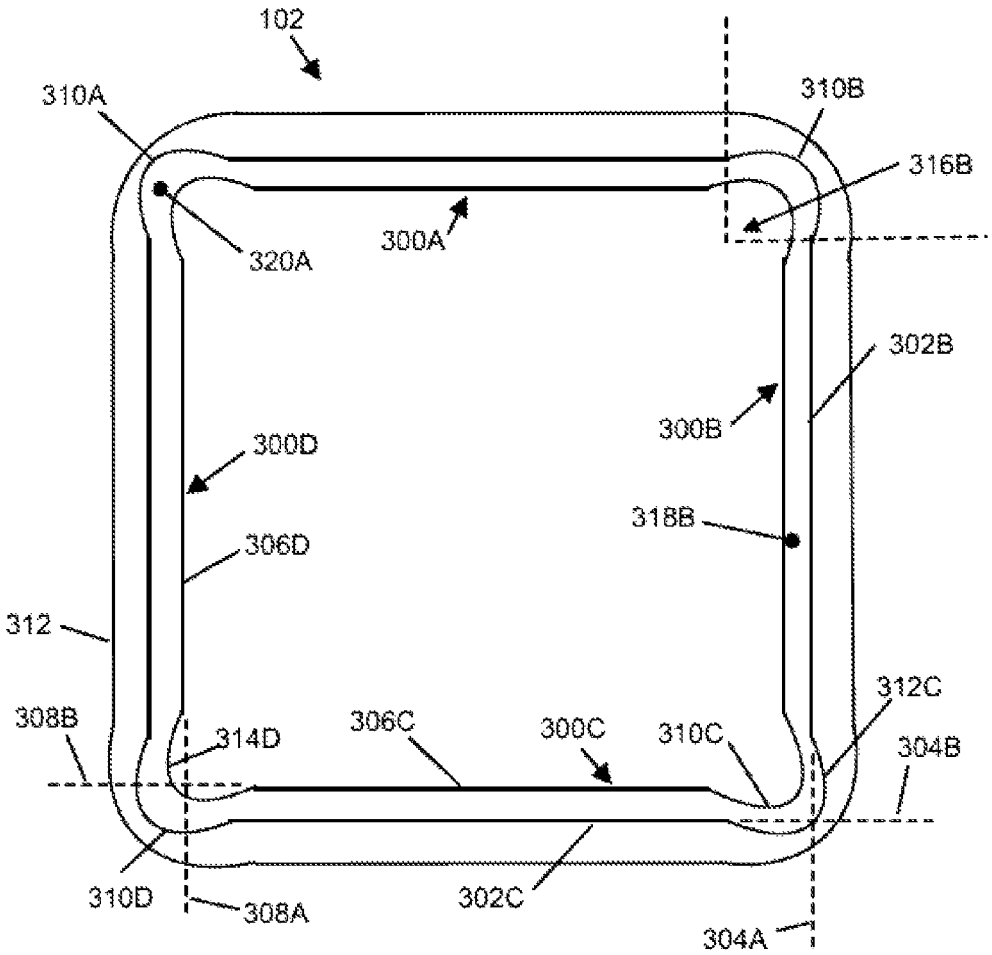
FIG. 3 is a bottom view illustration of the cover of the cooler.

FIG. 3 is a bottom view illustration of the cover 102 of the cooler 100 showing a plurality of walls 300A-300D, a plurality of partial columns 310A-310D, and an overlapping edge 316, the walls 300 alternating with the partial columns 310.

The outer surface 302 of a wall 300 defines a plane 304. For example, the outer surface 302B of wall 300B defines a plane 304B, the outer surface 302C of wall 300C defines another plane 304C, and so on. The outer surface 312 of a partial column 310 extends beyond the planes 304 of its associated walls 300. For example, the outer surface 312C of partial column 310C extends beyond planes 304B and 304C of associated walls 300B and 300C. In an embodiment, a partial column 310, such as partial column 310B, defines a corner angle, such as corner angle 316B, of approximately 90 degrees. Again, for clarity and convenience of illustration, not all planes or surfaces are shown or numbered.

The inner surface 306 of a wall 300 also defines a plane 308. For example, the inner surface 306D of wall 300D defines a plane 308D, the inner surface 306C of wall 300C defines another plane 308C, and so on. The inner surface 314 of a partial column 310 preferably extends beyond the planes 308 of its associated walls 300. For example, the inner surface 314D of partial column 310D preferably extends beyond planes 308C and 308D of associated walls 300C and 300D. Again, for clarity and convenience of illustration, not all planes or surfaces are shown or numbered.

In an embodiment, a wall 300, such as wall 300B, has a top surface 318, such as top surface 318B, and a partial column 310, such as partial column 310A, has a top surface 320, such as top surface 320A.

In an embodiment, a partial column 310, such as partial column 310B, defines a corner angle 316, such as corner angle 316B, of approximately 90 degrees.

The walls 300 and partial columns 310 fit within the walls 200 and partial columns 210 when the lid 102 is pressed on the body 108 to seal the cooler 100. The overlapping edge 316 preferably extends so as to completely cover the walls 200 and partial columns 210.

The cover 102 floats and can be used as a floating serving tray.

Figure 4:
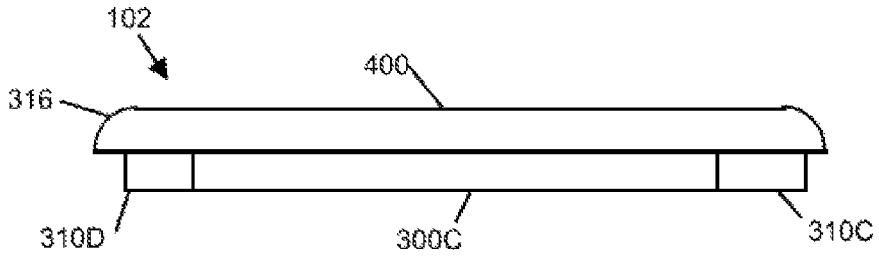
FIG. 4 is a side view illustration of the cover of the cooler.

FIG. 4 is a side view illustration of the cover 102 of the cooler 100 showing a top 400, a wall 300C, partial columns 310C and 310D, and the overlapping edge 316.

Figure 5:
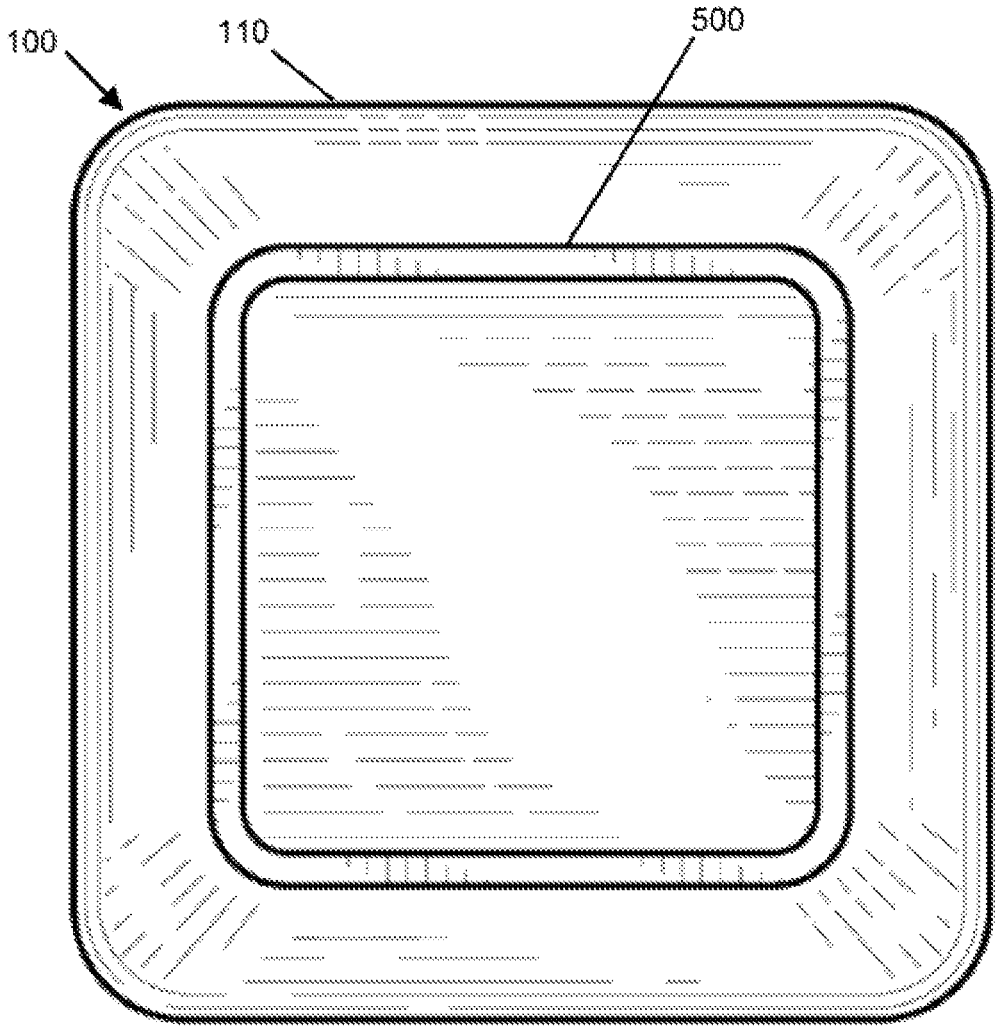
FIG. 5 is a bottom view illustration of the bottom section of the cooler showing a riser.

FIG. 5 is a bottom view illustration of the bottom section 110 of the cooler 100 showing a riser 500.

Figure 6:
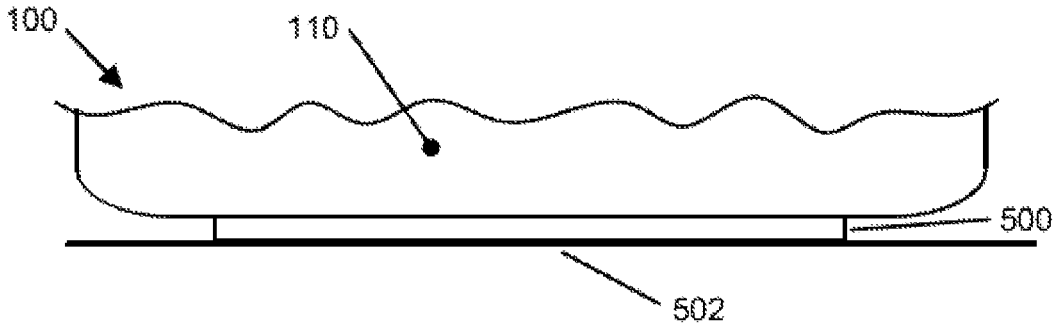
FIG. 6 is a bottom view illustration of the bottom section of the cooler showing the riser.

FIG. 6 is a bottom view illustration of the bottom section 110 of the cooler 100 showing the riser 500. The riser 500 minimizes the direct contact area between the cooler 100 and the surface 502 on which it is sitting and also traps the air surrounded by the riser 500, which serve to minimize heat transfer to the cooler 100 from the surface 502 on which it is sitting.

Figure 7:
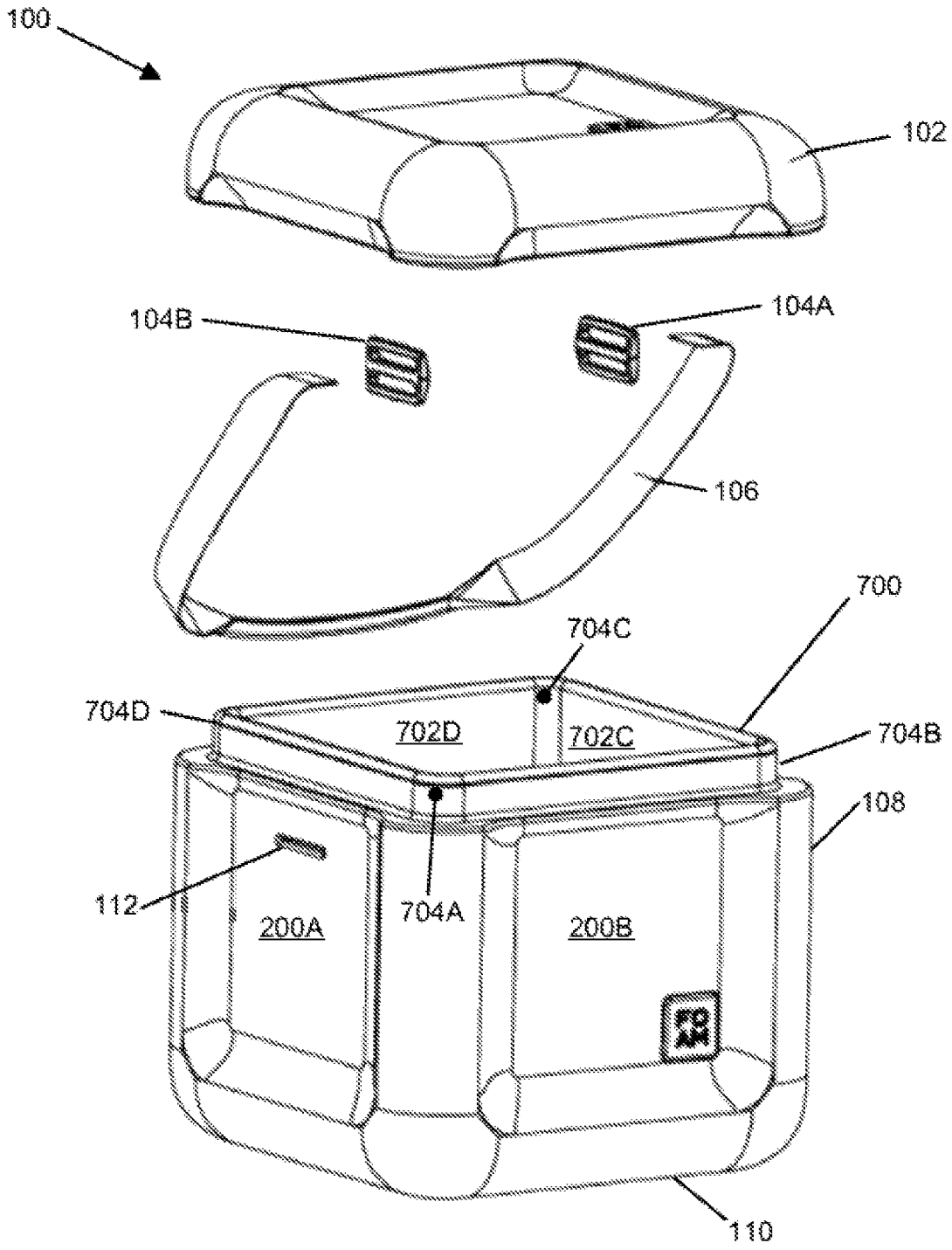
FIG. 7 is an exploded view illustration of another embodiment of a cooler.

FIG. 7 is an exploded view illustration of another embodiment of the cooler 100. As in the embodiment of FIG. 1, this embodiment also has the cover or lid 102, the center or body section 108, and the bottom section 110, and also has an internal liner 700. Also shown are the optional handle 106, buckles 104A, 104B, and one slot 112 of two optional slots into which the optional handle 106 and buckles 104 are inserted. In an embodiment, the center section 108 and the bottom section 110 are unitary, that is, a single molded piece.

The internal liner 700 preferably has walls 702 (e.g., 702C, 702D) and corners 704 (e.g., 704A-704D) which match the walls 200 and partial columns 208 (FIG. 2), and preferably fits snugly into and against the walls 200 and partial columns 208. In an embodiment, the internal liner 700 is hard plastic and extends approximately a ½ inch higher than the walls 200 and partial columns 208.

Figure 8:
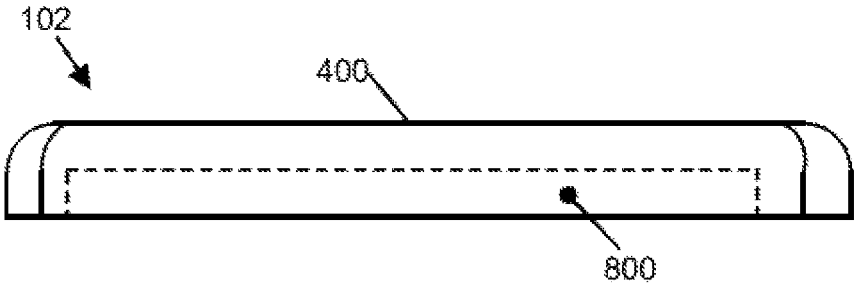
FIG. 8 is a side view illustration of the cover of the cooler of the embodiment of FIG. 7.

FIG. 8 is a side view illustration of the cover 102 of the cooler 100 of the embodiment of FIG. 7 showing an open volume or void 800 into which the internal liner 700 extends when the cover 102 is placed onto the body section 108 to close the cooler 100. The volume 800 is preferably deep enough to allow the cover 102 to contact the top surfaces of the walls 200 and the partial columns 208.

Figure 9:
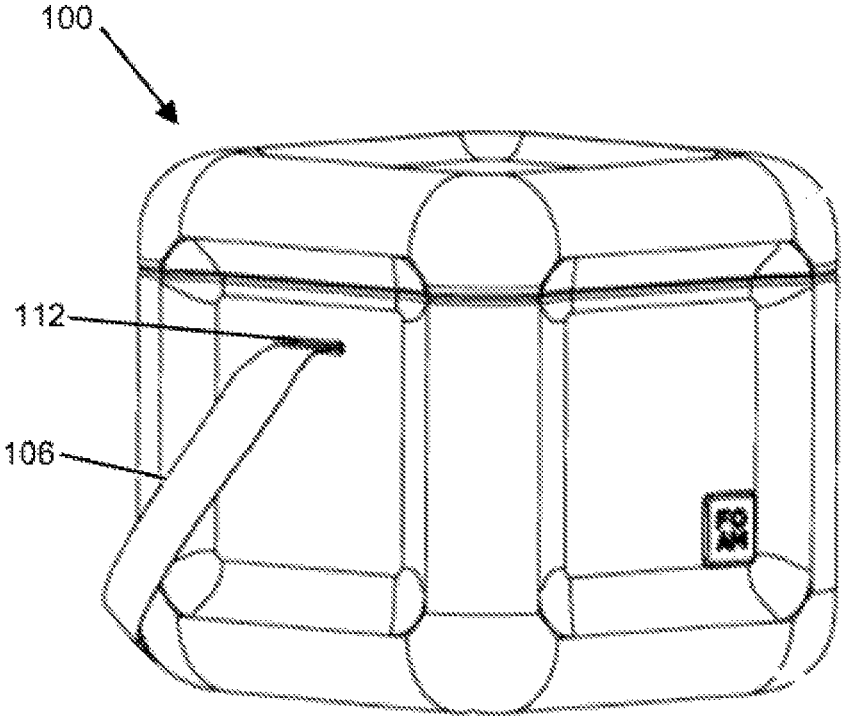
FIG. 9 is a corner view of the cooler of FIGS. 1 and 7.

FIG. 9 is a corner view of the cooler 100 of FIGS. 1 and 7, showing an optional handle 106 and an optional slot 112.

Figure 10:
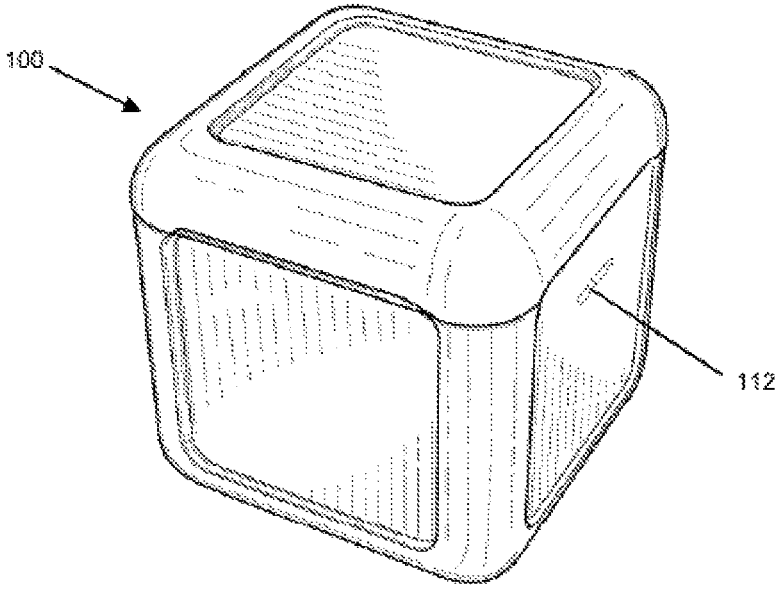
FIG. 10 is an upper perspective view of the cooler of FIGS. 1 and 7, showing an optional slot.

FIG. 10 is an upper perspective view of the cooler 100 of FIGS. 1 and 7, showing the optional slot 112.

Figure 11:
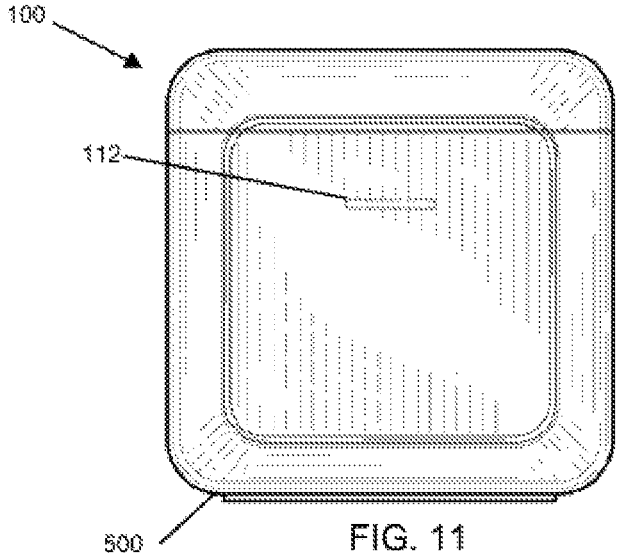
FIG. 11 is a side view of the cooler of FIGS. 1 and 7, showing the riser and the optional slot.

FIG. 11 is a side view of the cooler 100 of FIGS. 1 and 7, showing the riser 500 and the optional slot 112.

Figure 12:
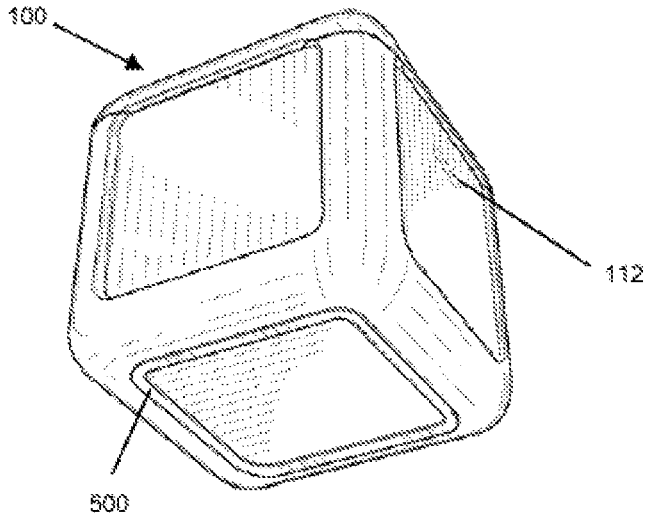
FIG. 12 is a bottom perspective view of the cooler of FIGS. 1 and 7, showing the riser and the optional slot.

FIG. 12 is a bottom perspective view of the cooler 100 of FIGS. 1 and 7, showing the riser 500 and the optional slot 112.

Figure 13:
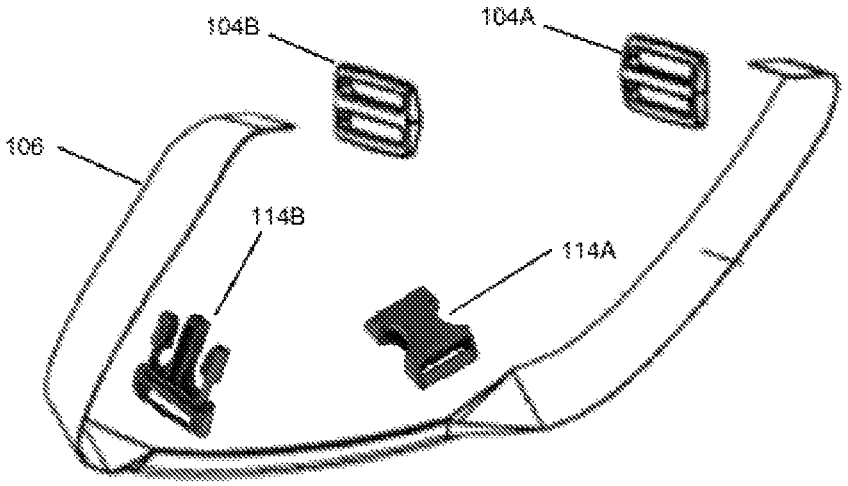
FIG. 13 is an illustration of the optional handle, buckles, and slide release buckle.

FIG. 13 is an illustration of the optional handle 106, buckles 104A, 104B, and releasable buckle 114A, 114B. The handle 106 is routed through the buckles 104A, 104B and the releasable buckle 114A, 114B. The handle 106 is then folded and stitched so as to secure the buckles 104A, 104B, and the releasable buckle 114A, 114B.

In an embodiment, handle 106 is a strap, such as a webbed strap.

In another embodiment, handle 106 may be a hard plastic, such as an ABS (Acrylonitrile Butadiene Styrene) plastic.

In an embodiment, the buckles 104A, 104B are tri-guide utility buckles.

In an embodiment, the buckles 104A, 104B are a hard plastic, such as an ABS plastic.

In an embodiment, releasable buckle 114A, 114B is a slide release buckle.

In an embodiment, the buckle 114A, 114B is a hard plastic, such as an ABS plastic.

In an embodiment, one or more of the walls 200A-200D, the partial columns 210A-210D, the walls 300A-300D, the partial columns 310A-310D, and the top 400 have a thickness of approximately ½ inch.

In an embodiment, the bottom section 110 has a thickness of approximately 1 inch.

In an embodiment, partial columns 210A-210D and 310A-310D each define an angle of approximately 90 degrees.

In an embodiment, the walls 200A-200D and the partial columns 210A-210D have a height of approximately 9 inches above the bottom section 110.

The construction and some embodiments of the cooler 100 having been discussed above, some further embodiments, advantages, and features are discussed below.

In an embodiment, the cooler 100 is made from a flexible foam which has good insulating properties, such as an ethylene-vinyl acetate (EVA) foam (a polymer of ethylene and vinyl acetate).

The R (insulation) value of EVA foam outperforms traditional foam material under both hot and cold temperatures so items within the cooler 100 will stay at their original same temperature for a long time as compared with conventional coolers.

EVA foam has a cross-linked structure and therefore provides flexibility, high durability, and sturdiness. EVA foam also has a tear value strength which is significantly higher than ordinary foams, and EVA foam will flex, thereby reducing the likelihood of cracks and breakage, and/or prevent cracks and breakage, under the conditions in which a cooler is normally used. EVA foam also has the ability to be compressed or deformed and then rebound to its original shape. An example of this would be that a person can sit on the cooler 100, thereby causing the cooler to partially collapse or deform, and then, when the person gets up, the cooler rebounds to its original shape.

EVA foam also provides protection from impacts so that the contents of the cooler 100 are protected if the cooler 100 falls of a table or chair or is dropped. EVA foam also provides vibration absorption. Further, EVA foam is resilient and is resistant to wear and scratches so that the cooler 100 has a long usage lifetime.

EVA foam can be made more stiff, or less stiff (floppy/flexible), so the rigidity of the coolers discussed herein can readily be customized for different applications. For example, a cooler sized to fit in a backpack may be made more flexible so that it will not feel hard and uncomfortable to the hiker, whereas a cooler intended to be used in a construction environment may be made more rigid so that it is easier to move around and will support light-weight objects.

Preferably, the EVA foam used for the cooler of FIG. 1 is flexible so that it is easily accommodates external forces, such as being dropped or a person sitting on it. A cooler, however, should have some structural rigidity. The partial columns 210 provide that rigidity and also encourage the cooler 100 to return to its original shape after it has been deformed. In addition, if a person sits on the cooler, the partial columns 210 will help keep the cooler 100 upright and stable as it is being compressed, by partially collapsing only on one side, rather than the weight of the person causing the cooler to turn over onto its side.

Also, EVA foam has a high coefficient of friction so objects placed inside the cooler 100 will not slip and slide around and bang against each other when the cooler 100 is being moved or jostled. The high coefficient of friction also means that the cooler 100 will not slip or slide when placed on or in a boat or car, thereby reducing the likelihood that it will overturn or fall off.

EVA foam will remain flexible at temperatures as low as −94 degrees F. so it maintains its toughness and usefulness at very low temperatures. Coolers made of conventional plastics tend to crack or to be brittle at low temperatures.

EVA foam also has good resistance to weather, ozone and UVA (ultraviolet-A) radiation so the coolers discussed herein are useful in different environments, especially outdoor environments, which is where coolers are most commonly used. Coolers made with conventional fabrics and/or plastics will degrade in color and/or structural integrity from prolonged exposure to ultraviolet (UV) light.

EVA foam also has high resistance to many common chemicals, such as dilute acids, dilute alkalis, oils, greases, aliphatic hydrocarbons, and alcohols. Fabric soft sided coolers can absorb, be discolored by, and/or be degraded by, many common chemicals and other liquids. Mold growth is a problem for many coolers, but EVA foam is antibacterial, or at least is not conducive to bacterial growth, so mold growth is not a problem.

EVA foam is a sulfur free and low odor material, it does not release ammonia or other organic odors. EVA foam is nontoxic, and is Bisphenol A (BPA) free. The manufacturing processes for conventional plastic coolers are often highly toxic, and conventional plastic coolers often have a high residual odor for the lifetime of the product.

A cooler 100, made with EVA foam, is buoyant so it will float, with low water absorption so it will not soak up water in which it is sitting or subject to, such as rain.

A cooler 100, made with EVA foam, absorbs sound so, unlike conventional coolers, ice or drinks sloshing around will not make an undue amount of noise.

As mentioned, EVA foam is flexible and can absorb impacts so, if the cooler 100 is dropped on your foot, it will not be as painful as if a hard plastic cooler were dropped on your foot. EVA foam, being flexible, also will not scratch other surfaces, such as the hood or trunk lid of a car, or the deck or floor of a boat.

It is quite common for a person to sit on a cooler. EVA foam is soft and flexible, and sometimes used in seating cushions, so the coolers 100 discussed herein are more comfortable than plastic- or metal-sided coolers.

The coolers 100 discussed herein can provide a hybrid of a soft-sided (more flexible) cooler and a hard-sided (more rigid) cooler as EVA foam can be customized to be more flexible or more rigid.

EVA foam can be manufactured in different colors, and different patterns can be molded or pressed onto it, EVA foam can be manufactured with one or more undercuts, and EVA foam expands after being molded. This allows unique, innovative, trending, and/or interesting cooler 100 designs that are not possible and/or are very expensive with traditional thermoplastic or metal molding or forming.

EVA foam is non-flammable so the coolers 100 discussed herein are flame- and fire-resistant.

The coolers 100 discussed herein can easily be recycled, such as by grinding, as EVA foam is free of solvents and heavy metals, such as lead, mercury, chromium, cadmium, nickel, antimony, arsenic formaldehyde, phthalates, polyaromatic hydrocarbons, benzene, and chlorofluorocarbons.

The figures and descriptions provided herein may have been simplified to illustrate aspects that are relevant for a clear understanding of the herein described devices, systems, and methods, while eliminating, for the purpose of clarity, other aspects that may be found in typical devices, systems, and methods. Those of ordinary skill may recognize that other elements and/or operations may be desirable and/or necessary to implement the devices, systems, and methods described herein. Because such elements and operations may be well known in the art, and because they do not facilitate a better understanding of the present disclosure, a discussion of such elements and operations is not provided herein. The present disclosure is deemed to inherently include all such elements, variations, and modifications to the described aspects that would be known to those of ordinary skill in the art, particularly in view of reading the present disclosure. Any headings used herein are for organizational purposes only and are not meant to be used to limit the scope of the description or the claims.

The terminology used herein is for the purpose of describing particular example embodiments or implementations only and is not intended to be limiting. As used herein, the singular forms "a", "an", and "the" may be intended to include the plural forms as well, unless the context clearly indicates otherwise.

The terms "comprises," "comprising," "includes," "including," "has," "having," and variations in form thereof are inclusive or variations in form thereof are intended to be inclusive in a manner similar to the term "comprises" as that term is interpreted when employed as a transitional word in a claim, and therefore specify the presence of stated features, integers, steps, operations, elements, and/or components, but do not preclude the presence or addition of one or more other features, integers, steps, operations, elements, components, and/or groups thereof unless explicitly stated otherwise or the context clearly requires otherwise.

The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc., may be used herein to describe various elements, components, regions, layers and/or sections, these elements, components, regions, layers and/or sections should not be limited by these terms. These terms may be only used to distinguish one element, component, region, layer or section from another element, component, region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the exemplary embodiments and implementations.

Unless otherwise defined, all terms (including technical and scientific terms) used herein have the same meaning as commonly understood by one of ordinary skill in the art to which this subject matter belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. For brevity and/or clarity, well-known functions or constructions may not be described in detail herein.

The terms "for example" and "such as" mean "by way of example and not of limitation." The subject matter described herein is provided by way of illustration for the purposes of teaching, suggesting, and describing, and not limiting or restricting. Combinations and alternatives to the illustrated embodiments and implementations are contemplated, described herein, and set forth in the claims.

The term "exemplary" is used herein to mean serving as an example, instance, or illustration. Any aspect or design described herein as "exemplary" is not necessarily to be construed as preferred or advantageous over other aspects or designs. Similarly, examples are provided herein solely for purposes of clarity and understanding and are not meant to limit the subject innovation or portion thereof in any manner.

For convenience of discussion herein, when there is more than one of a component, that component may be referred to herein either collectively or singularly by the singular reference numeral unless expressly stated otherwise or the context clearly indicates otherwise. For example, components N (plural) or component N (singular) may be used unless a specific component is intended. Also, the singular forms "a," "an," and "the" are intended to include the plural forms as well, unless expressly stated otherwise or the context indicates otherwise.

The terms "includes," "has," "having," or "exhibits," or variations in form thereof are intended to be inclusive in a manner similar to the term "comprises" as that term is interpreted when employed as a transitional word in a claim.

It will be understood that when a component is referred to as being "connected" or "coupled" to another component, it can be directly connected or coupled or coupled by one or more intervening components unless expressly stated otherwise or the context clearly indicates otherwise.

The term "and/or" includes any and all combinations of one or more of the associated listed items.

As used herein, phrases such as "between X and Y" and "between about X and Y" should be interpreted to include X and Y unless expressly stated otherwise or the context clearly indicates otherwise.

Terms such as "about", "approximately", "around", and "substantially" are relative terms and indicate that, although two values may not be identical, their difference is such that the apparatus or method still provides the indicated or desired result, or that the operation of a device or method is not adversely affected to the point where it cannot perform its intended purpose. As an example, and not as a limitation, if a height of "approximately X inches" is recited, a lower or higher height is still "approximately X inches" if the desired function can still be performed or the desired result can still be achieved.

While terms such as vertical, horizontal, upper, lower, bottom, top, and the like may be used herein, it is to be understood that these terms are used for ease in referencing the drawing and, unless otherwise indicated or required by context, does not denote a required orientation.

The different advantages and benefits disclosed and/or provided by the implementation(s) disclosed herein may be used individually or in combination with one, some or possibly even all of the other benefits. Furthermore, not every implementation, nor every component of an implementation, is necessarily required to obtain, or necessarily required to provide, one or more of the advantages and benefits of the implementation.

Conditional language, such as, among others, "can", "could", "might", or "may", unless specifically stated otherwise, or otherwise understood within the context as used, is generally intended to convey that certain embodiments and implementations preferably or optionally include certain features, elements and/or steps, while some other embodiments and implementations optionally do not include those certain features, elements and/or steps. Thus, such conditional language indicates, in general, that those features, elements and/or steps are used in a permissive sense rather than a mandatory sense, and may not be required for every implementation or embodiment.

The subject matter described herein is provided by way of illustration only and should not be construed as limiting the nature and scope of the claims herein. While different embodiments and implementations have been provided above, it is not possible to describe every conceivable combination of components or methodologies for implementing the disclosed subject matter, and one of ordinary skill in the art may recognize that further combinations and permutations that are possible. Furthermore, the nature and scope of the claims is not necessarily limited to implementations that solve any or all disadvantages which may have been noted in any part of this disclosure. Various modifications and changes may be made to the subject matter described herein without departing from the spirit and scope of, the exemplary embodiments, implementations, and applications illustrated and described herein.

Although the subject matter presented herein has been described in language specific to components used therein, it is to be understood that the scope of the claims is not necessarily limited to the specific components or characteristics thereof described herein; rather, the specific components and characteristics thereof are disclosed as example forms of implementing the disclosed subject matter. Accordingly, the disclosed subject matter is intended to embrace all alterations, modifications, and variations, that fall within the scope and spirit of any claims included herein or that may be written.

The foregoing Detailed Description is intended only to convey to a person having ordinary skill in the art the fundamental aspects of the disclosed subject matter and is not intended to limit, and should not be construed as limiting, the scope of any claims. Further, in the foregoing Detailed Description, various features may be grouped together in a single embodiment or implementation for the purpose of streamlining the disclosure. This method of disclosure is not to be interpreted as reflecting an intention that a claimed embodiment, implementation, or application requires more features than are expressly recited in a claim. Rather, claims reflect patentable subject matter which may lie in less than all features of a single disclosed embodiment, implementation, or application. Thus, all claims which may be present herein are hereby incorporated into the Detailed Description, with each claim standing on its own as a separate embodiment, implementation, or application.

The invention claimed is:

1. A container, comprising:

a center section comprising:

a plurality of outer walls, each outer wall having an inner surface, an outer surface, a top surface, a thickness, and a plane defined by the outer surface;

a plurality of partial columns, each partial column having an inner surface, an outer surface, a top surface, a thickness, and defining an angle; and the partial columns alternating with the outer walls, the outer surface of a partial column of the plurality of partial columns extending beyond the plane of an adjacent outer wall of the plurality of outer walls; and a bottom section;

wherein the center section and the bottom section are a unitary structure formed of a flexible insulating material.

2. The container of claim 1, wherein the angle is approximately 90 degrees.

3. The container of claim 1, wherein the flexible insulating material is a flexible foam.

4. The container of claim 1, wherein the flexible insulating material is an ethylene-vinyl acetate (EVA) foam.

5. The container of claim 1, wherein the top surfaces of the plurality of partial columns and the plurality of outer walls define a top plane.

6. The container of claim 1, wherein the plurality of outer walls and the plurality of partial columns define a storage volume, and further comprising a cover, the cover comprising:

a plurality of cover walls, each cover wall having an inner cover surface, an outer cover surface, a top cover surface, a cover thickness, and a cover plane defined by the outer cover surface;

a plurality of partial cover columns, each partial cover column having an inner cover surface, an outer cover surface, a top cover surface, a cover thickness, and defining an angle;

the partial cover columns alternating with the cover walls, the outer cover surface of a partial cover column of the plurality of partial cover columns extending beyond the cover plane of an adjacent cover wall of the plurality of cover walls; and a top cover section;

wherein the cover walls, the partial cover columns, and the top cover section are a unitary structure formed of a flexible material; and wherein the plurality of cover walls and the plurality of partial cover columns fit within the plurality of outer walls and the plurality of partial columns to seal the storage volume.

7. The container of claim 1, wherein:

an outer wall of the plurality of outer walls has a first slot therein, and an opposing outer wall of the plurality of outer walls has a second slot therein, the first and second slots being nearer to the top plane than to the bottom section.

8. The container of claim 7, further comprising a strap with a first buckle attached at a first end, and with a second buckle attached at a second end, wherein the first buckle will pass through the first slot when oriented in a first direction but will not pass through the first slot when oriented in a second direction.

9. The container of claim 8, wherein a male part of a utility buckle is attached to the strap at a first point, and a corresponding female part of the utility buckle is attached to the strap at a second point.

10. A container, comprising:

a center section comprising:

a plurality of outer walls, each outer wall having an inner surface, an outer surface, a top surface, a thickness, and a plane defined by the outer surface;

a plurality of partial columns, each partial column having an inner surface, an outer surface, a top surface, a thickness, and defining an angle;

the partial columns alternating with the outer walls, the outer surface of a partial column of the plurality of partial columns extending beyond the plane of an adjacent outer wall of the plurality of outer walls; and wherein the plurality of outer walls and the plurality of partial columns define a volume;

a liner having a plurality of walls, the liner fitting inside the volume and making contact with the inner surfaces of the outer walls; and a bottom section;

wherein the center section and the bottom section are a unitary structure formed of a flexible insulating material.

11. The container of claim 10, wherein the liner extends beyond the top surfaces of the outer walls and the partial columns.

12. The container of claim 10, wherein the angle is approximately 90 degrees.

13. The container of claim 10, wherein the flexible insulating material is a flexible foam.

14. The container of claim 10, wherein the flexible insulating material is an ethylene-vinyl acetate (EVA) foam.

15. The container of claim 10, wherein the top surfaces of the plurality of partial columns and the plurality of outer walls define a top plane.

16. The container of claim 10, and further comprising a cover, the cover comprising:

a plurality of outer cover walls, each outer cover wall having an inner cover surface, an outer cover surface, a top cover surface, a cover thickness, and a cover plane defined by the outer cover surface;

a plurality of partial cover columns, each partial cover column having an inner cover surface, an outer cover surface, a top cover surface, a cover thickness, and defining an angle;

the partial cover columns alternating with the cover walls, the outer cover surface of a partial cover column of the plurality of partial cover columns extending beyond the cover plane of an adjacent cover wall of the plurality of cover walls; and a top cover section;

wherein the outer cover walls, the partial cover columns, and the top cover section are a unitary structure formed of a flexible insulating material.

17. The container of claim 10, wherein:

an outer wall of the plurality of outer walls has a first slot therein, and an opposing outer wall of the plurality of outer walls has a second slot therein, the first and second slots being nearer to the top plane than to the bottom section.

18. The container of claim 17, further comprising a strap with a first buckle attached at a first end, and with a second buckle attached at a second end, wherein the first buckle will pass through the first slot when oriented in a first direction but will not pass through the first slot when oriented in a second direction.

19. The container of claim 18, wherein a male part of a utility buckle is attached to the strap at a first point, and a corresponding female part of the utility buckle is attached to the strap at a second point.

20. A container, comprising:

a center section comprising:

a plurality of outer walls, each outer wall having an inner surface, an outer surface, a top surface, a thickness, and a plane defined by the outer surface, wherein an outer wall of the plurality of outer walls has a first slot therein, and an opposing outer wall of the plurality of outer walls has a second slot therein, the first and second slots being nearer to the top plane than to the bottom section;

a plurality of partial columns, each partial column having an inner surface, an outer surface, a top surface, a thickness, and defining an angle, wherein the angle is approximately 90 degrees; and the partial columns alternating with the outer walls, the outer surface of a partial column of the plurality of partial columns extending beyond the plane of an adjacent outer wall of the plurality of outer walls; and wherein the top surfaces of the plurality of partial columns and the plurality of outer walls define a top plane; and a bottom section;

a strap with a first buckle attached at a first end, and with a second buckle attached at a second end, wherein the first buckle will pass through the first slot when oriented in a first direction but will not pass through the first slot when oriented in a second direction;

a utility buckle, a male part of the utility buckle being attached to the strap at a first point, and a corresponding female part of the utility buckle being attached to the strap at a second point;

wherein the center section and the bottom section are a unitary structure formed of an ethylene-vinyl acetate (EVA) foam.

* * * * *